US009271615B1

(12) United States Patent
Stephens

(10) Patent No.: US 9,271,615 B1
(45) Date of Patent: Mar. 1, 2016

(54) METHOD OF INSTALLATION OF BATHROOM ACCESSORIES

(71) Applicant: Nash Stephens, Douglasville, GA (US)

(72) Inventor: Nash Stephens, Douglasville, GA (US)

( * ) Notice: Subject to any disclaimer, the term of this patent is extended or adjusted under 35 U.S.C. 154(b) by 0 days.

(21) Appl. No.: 14/538,967

(22) Filed: Nov. 12, 2014

(51) Int. Cl.
*E04B 1/00* (2006.01)
*A47K 10/10* (2006.01)
*E04F 11/18* (2006.01)

(52) U.S. Cl.
CPC ..... *A47K 10/10* (2013.01); *E04F 11/1804* (2013.01)

(58) Field of Classification Search
CPC ..... A47K 10/10; E04F 11/1804
USPC ..... 52/741.1
See application file for complete search history.

(56) References Cited

U.S. PATENT DOCUMENTS 2,402,127 A * 6/1946 Cohn ..... 211/123
3,384,333 A * 5/1968 Bohlman et al. ..... 248/251
3,825,229 A * 7/1974 Bartlett et al. ..... 256/59
4,353,529 A * 10/1982 Brown ..... 256/59
5,026,012 A * 6/1991 Wang ..... 248/222.14
5,743,064 A * 4/1998 Bennett ..... 52/718.04
5,894,610 A * 4/1999 Winter ..... 4/558
5,908,185 A * 6/1999 Collette et al. ..... 248/345.1
6,012,692 A * 1/2000 Meck ..... 248/251
6,036,156 A * 3/2000 Collette et al. ..... 248/345.1
6,508,458 B1 * 1/2003 Bartlett et al. ..... 256/65.08
7,641,161 B2 * 1/2010 Bauer ..... 248/221.11
7,967,522 B2 * 6/2011 Goad ..... 403/292
8,382,051 B2 * 2/2013 Smith ..... 248/221.11
2002/0023993 A1 * 2/2002 Fleischmann et al. ..... 248/315
2009/0223912 A1 * 9/2009 Chen ..... 211/48
2014/0026402 A1 * 1/2014 Austin et al. ..... 29/700

FOREIGN PATENT DOCUMENTS

WO WO 9209230 A1 * 6/1992 ..... A47K 10/00

* cited by examiner

*Primary Examiner* — Joshua J Michener
*Assistant Examiner* — Keith Minter
(74) *Attorney, Agent, or Firm* — Robert J. Van Der Wall

(57) ABSTRACT

Disclosed is a method of installing bathroom accessories such as towel racks on the walls of a bathroom. The method includes the following primary steps: revising accessories if said accessories lack horizontal wall fastener apertures to provide that they have at least one such aperture, selecting a location to place an accessory and marking it, drilling a fine opening at each mark to determine whether a wall stud is disposed at such opening, drilling a big enough hole to accommodate an expansion anchor collapsed end at each fine opening where no wall stud has been located, locating the accessory at that point, inserting fasteners into each aperture using a screw if a wall stud was found at that opening and using an expansion anchor at the other locations, tightening the fasteners while inserting any central element such as a towel bar, completing tightening, and covering each fastener with a cover cap.

4 Claims, 1 Drawing Sheet

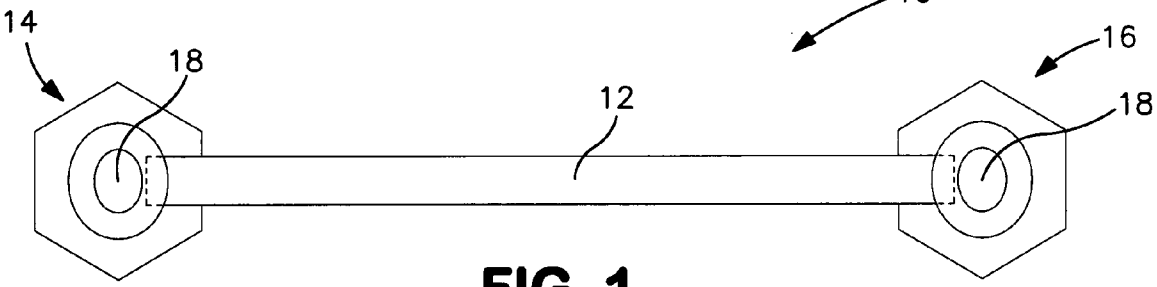
FIG. 1
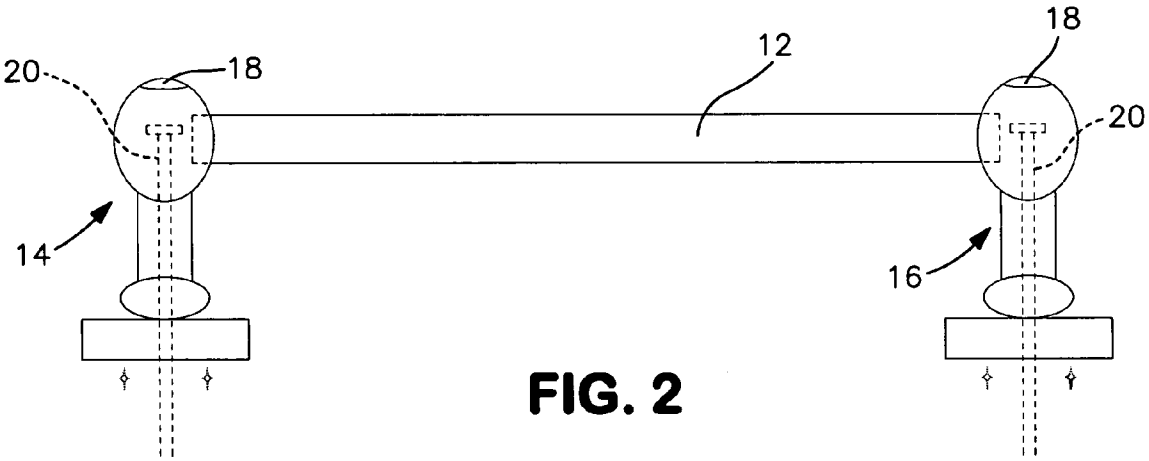
FIG. 2
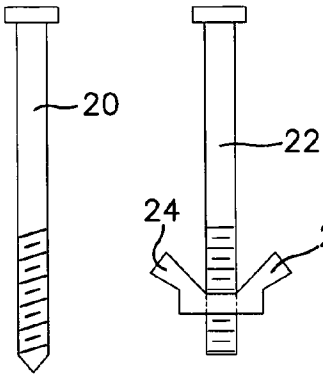
FIG. 3
FIG. 4

METHOD OF INSTALLATION OF BATHROOM ACCESSORIES

CROSS REFERENCE TO RELATED APPLICATION

The present application is with provisional patent application Ser. No. 61/903,603 filed Nov. 13, 2013, and claims that filing date as to all matter in this application that is common between the two applications.

BACKGROUND OF THE INVENTION

1. Field of the Invention

The present invention relates to the field of a method of the attachment of bathroom accessories to bathroom walls. The present method simplifies this process, speeds it up thereby reducing labor and uses fewer parts. It is, therefore, less expensive.

2. Description of the Prior Art

A significant aspect of the prior art is provided by the apparatus being sold at the time of the writing of this application. The present invention concerns a method, not an apparatus, but the form of the presently sold prior art apparatus teaches the method by which it is necessarily installed. These days there is no known bathroom accessories being sold which use horizontal fasteners in the absence of mounting plates and set screws. In contrast the present invention eliminates mounting plates, mounting plate fasteners, templates, and set screws as a major part of the simplification of the installation method.

The presently sold bathroom accessories require the installer to first locate a mounting position and then use a template to locate a position for attaching to the wall a mounting plate in the vicinity of each portion of the accessory to be attached to the wall. Thus a towel rack or toilet paper holder each have a bracket to be attached to the wall at each end, thereby requiring the installer to position at least two mounting plates and then attach each of them to the wall with a plurality of fasteners for each of these accessories. Thereafter, each bracket is hung on an upper lip of the mounting plate, and then a set screw on the underside of each bracket must be threaded into a lower lip of the mounting plate and tightened. The latter step is very awkward. In the case of a toilet paper holder between the side of a toilet bowl and the wall, seeing the two set screws that have downwardly facing heads and tightening them in an upward direction is not a simple matter.

The present invention greatly simplifies the installation method by eliminating the mounting plates, the mounting plates fasteners, the templates, and the set screws. Beside each accessory, there is only one or two primary fasteners.

While fasteners are a necessary component of both the present invention and the prior art, and thus contribute nothing to the issue of patentabilty of the present invention, it is useful to understand the types of fasteners that are relevant to the description of the invention. It is also useful to review the terminology used in the industry that will be employed in this application. In the United States, residential interior walls are usually comprised of wall board, also called drywall or sheet rock, although there are some, particularly older structures, that are comprised of lath and plaster.

It is assumed for purposes of this application that all residential interior walls are hollow and supported by interior studs. Therefore, drilling into residential interior walls results in reaching either a hollow area or a stud. Reaching a stud results in being able to use a simple fastener such as a screw.

Reaching a hollow area dictates the use of expandable fasteners, also described as anchors, or "molly bolts." These include the following fasteners: winged plastic anchor, plug anchor, expansion anchor, drive-in expansion anchor, toggle bolt, winged nylon toogle anchor, strap toggle anchor, a wedge anchor, and the like. For purposes of this application, all expandable fasteners will be referred to as "expansion anchors." All fasteners that include both expansion anchors and conventional fasteners will be simply referred to as "fasteners."

A preexamination search of the prior art revealed an amazing amount of complexity in apparatus used for mounting bathroom accessories. Illustrative of that are three references herewith briefly described. The first of these is Bauer, U.S. Pat. No. 7,641,161 for "Bathroom Accessory Mounting Assembly and Method of Mounting" described therein is a mounting assembly that includes a mounting bracket, fastener, flange and post. The mounting bracket includes an axially extending body portion that receives the post.

The mounting bracket includes a snap flange that cooperates with the post to secure the post to the mounting bracket.

The second reference is Smith, U.S. Pat. No. 8,382,051 for a "Wall-Mounted Support Assembly for Bath Accessories". It describes mounting bracket, a fastener assembly adapted to a fixed mounting bracket to a wall board, and accessory post assembly including an accessory post assembly including an accessory post and a post adapter commonly affixed to the accessory post, the accessory post including a wall defining essential body and a distal portion extending axially from the end of central body, the distal portion configured to support a bathroom accessory, etc. The complexity of this is shown by the fact that it required 20 drawing figures to adequately described it for patent purposes.

The third reference is Austin, I I I et al. U.S. Patent Publication Number US2014/0026402 for a "Hardware Mounting Bracket Assembly and Hardware". Is described as bracket body adapted to be mounted to a support surface, with a rigid retainer provided on one of the bracket body to receive hardware supported thereon, with at least on elongate biasing retainer on another end of the bracket body spaced apart from the rigid retainer to engaged hardware supported thereon and to provide a loaded surface contact with hardware supported thereon. Once again, complexity can be seen in the drawings which required 10 drawing figures to describe it. By contrast the present invention requires only one screw or expansion anchor for each bracket and eliminates such parts as set screws, templates, mounting plates, and mounting plate fasteners for each bracket. Therefore, mounting a towel bar requires only two fasteners comprised of either screws or expansion anchors depending on the wall content thus reducing the expense of the product, reducing the number of parts, reducing the number of steps in the mounting method, and simplifying the complexity of the steps in the method.

SUMMARY OF THE INVENTION

Bearing in mind the foregoing, it is a principal object of the present invention is to provide a method of installation of bathroom accessories by greatly simplifying the method through the reduced number steps, which have the incidental advantage of reducing the complexity of the invention, and the number of parts involved.

A second principal object of the present invention is to reduce the cost to manufacture accessories for the bathroom.

A related object of the present invention is to reduce the labor involved in such installation, which further reduces cost to the homeowner or purchaser.

A further related purpose of the present invention is to render the method of installation so simplified that it becomes more advantageous for use by do it yourself homeowners.

Another object of the present invention is to reduce a minimum a number of tools necessary to complete installation. For example, it eliminates the necessity to use tiny screwdrivers for set screws and to eliminate the set screws which, in present day prior art, are used underneath the bracket to affix the bracket to a mounting plate which set screws are downwardly facing and difficult to reach and manipulate. It also eliminates templates.

Other objects and advantages will be apparent to those skilled in the art upon consideration of the following descriptions and the appended drawings.

The overwhelming majority of the interior walls of residences in the United States are comprised of vertical studs that support wall board, also called drywall or sheet rock. The following method assumes that construction of the interior walls of the residence structures includes some hollow areas between the supporting studs, and it does not matter whether the external surfaces are wall board or lath and plaster. The following description assumes installation of a towel bar, but the method is easily adaptable to other accessories such as toilet paper holders, ring style hand clothes hangers, soap and toothbrush holders, soap dispensers and paper towel holders, etc.

In accordance with a primary aspect of the present invention, there are provided modified brackets in which a single fastener is provided for each bracket. The brackets are modified to accept a single horizontally oriented screw or expansion anchor in each bracket at each point of attachment to the wall. The apparatus is also revised to include a cover cap over the fastener. These changes facilitate the method which includes the following steps:

revising accessories if said accessories lack horizontal wall fastener apertures to provide that they have at least one horizontal wall fastener aperture for use with a wall fastener at each attachment position;

selecting a location to place an accessory;

marking the location of fastener apertures on the wall;

penetrating the wall at each mark with a fine opening to ascertain whether a wall stud is disposed at such opening;

drilling a hole having sufficient diameter to accommodate a collapsed end of an expansion anchor at each fine opening where no wall stud has been located;

positioning the accessory at the location selected in alignment with the fine opening and drilled holes as appropriate;

inserting a fastener into each horizontal wall fastener aperture using a conventional fastener if a wall stud was found at that fine opening and using an expansion anchor where a hole has been drilled to accommodate the collapsed end of the expansion anchor;

begin tightening each fastener and insert any central element such as a towel bar;

completing tightening each fastener; and covering each fastener with a cover cap.

These steps can be readily supplemented by the use of a level at one or two points in the method, and the use of an awl, pointed punch, small screwdriver, or small diameter drill to produce a fine opening for determining the presence or absence of a stud in the wall at each attachment point.

The invented method will be better understood upon reference to the following drawings and detailed description of the preferred embodiment.

BRIEF DESCRIPTION OF THE DRAWINGS

Various other objects, advantages, and features of the invention will become apparent to those skill in the art from the following discussion taken in conjunction with the appended drawings, in which:

FIG. 1 is a front elevation view of the apparatus employed with the invented method.

FIG. 2 is a top view of the apparatus used with the present method.

FIG. 3 is a first form of fastener used the apparatus of the present method.

FIG. 4 is the second form of fastener used the apparatus of the present method.

DETAILED DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

FIG. 1 is a front elevation view of apparatus used with the present invention 10. A towel bar 12 is disposed between left side bracket 14 and right side 16. Each of the brackets features a fastener cover cap 18.

In FIG. 2, towel bar 12 remains disposed between left side bracket 14 and right side bracket 16. On each of these brackets can be seen fastener cover cap 18 but is also seen in phantom are fasteners 20.

In FIG. 3, the fasteners shown in phantom 20 in FIG. 2 is illustrated. This type of fastener is used if a stud is encountered in the wall where each of the two brackets in FIG. 2 is to be placed. Fastener 20 is a 4 inch screw with a flat top head in which maybe disposed a recess for a flat screw driver or a phillips head screwdriver.

Turning finally to FIG. 4, there is displayed a toggle bolt 22. Toggle bolt 22 includes wing tips 24. Wing tips 24 are pivot mounted and spring loaded as illustrated in FIG. 4, but the pivot mounted means that they can be compressed against the shaft of toggle bolt 44 permitting them to be inserted into a hole large enough to be accept that assembly. When inserted into the hole and pushed through to the hollow opening inside the wall the spring loading causes the wing tips to spring out to the position that they are shown in FIG. 4 and then the toggle bolt 22 can be tightened up so that the wing tips pressed against the back side of the wall board or sheet rock so that the bolt is firmly held in place including the bracket through in which it has been inserted prior to being placed inside the wall. Toggle bolt 22 is one of several similar structures that can be collapsed for hollow wall construction. A similar one not illustrated but well known in the industry is a structure often referred to as a molly bolt in which tightening the screw portion thereof from its head compresses a structure which forces flexible members to expand outward which also serve to hold tightly against the back of the sheet rock so that the structure functions in the same way as the toggle bolt 22 illustrated in FIG. 4.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method of installation of a bathroom accessory on a wall of a bathroom comprising:

revising said accessory by forming at least one horizontal wall fastener aperture in the accessory;

selecting a location to place said accessory;

marking the location of at least one fastener aperture on the wall;

penetrating the wall at each mark with an apparatus to create an opening to ascertain whether a wall stud is disposed at said opening;

drilling at least one hole having a diameter to accommodate a collapsed end of an expansion anchor at each opening where no wall stud has been located;

positioning the accessory at the location selected in alignment with the opening and the drilled at least one hole;

inserting a fastener into each horizontal wall fastener aperture using a fastener without an expansion anchor when a wall stud is found at said at least one opening and using an expansion anchor where a hole has been drilled to accommodate the collapsed end of the expansion anchor;

begin tightening each fastener and apply the accessory thereto;

completing tightening each fastener; and covering each fastener with a cover cap.

2. The method of claim 1 which further comprises using a level on the accessory to make its position horizontal before marking the location of fastener apertures on the wall.

3. The method of claim 1 which further comprises using a level on the accessory to make its position horizontal before tightening any fastener.

4. The method of claim 1 which further comprises using one of an awl, pointed punch, screwdriver, or drill to create the opening used to ascertain whether a stud is disposed at each mark.

* * * * *